US006050031A

United States Patent [19]

Lewis, III et al.

[11] Patent Number: 6,050,031

[45] Date of Patent: Apr. 18, 2000

[54] APPARATUS AND METHOD FOR PREVENTING UNAUTHORIZED ENTRY INTO A STRUCTURE THROUGH AN OPENING CONTAINING AN AIR CONDITIONER

[75] Inventors: William Lewis, III, New York, N.Y.; Joseph William Strasser, Jr., Hawley, Pa.

[73] Assignee: J. W. Technologies, Hawley, Pa.

[21] Appl. No.: 08/838,964

[22] Filed: Apr. 23, 1997

[51] Int. Cl.[7] ..... E06D 3/68

[52] U.S. Cl. ..... 52/37; 49/55

[58] Field of Search ..... 52/37; 49/55

[56] References Cited

U.S. PATENT DOCUMENTS

| | | | |
|---|---|---|---|
| 522,523 | 7/1894 | Hickethier et al. . | |
| 582,681 | 5/1897 | Pigneron . | |
| 1,497,694 | 6/1924 | Neff . | |
| 1,550,404 | 8/1925 | Vincent . | |
| 1,634,843 | 7/1927 | McWane . | |
| 1,891,588 | 12/1932 | Claus . | |
| 1,925,888 | 9/1933 | Weiss | 52/37 |
| 1,942,233 | 1/1934 | Applugliese | 52/37 |
| 2,171,446 | 8/1939 | Hines . | |
| 2,182,396 | 12/1939 | Copp . | |
| 2,303,718 | 12/1942 | Becker et al. . | |
| 2,532,590 | 12/1950 | Anastasi | 52/37 |
| 2,793,050 | 5/1957 | Cook . | |
| 3,116,519 | 1/1964 | Keith . | |
| 3,738,062 | 6/1973 | Ughi . | |
| 4,598,508 | 7/1986 | Baum . | |
| 4,633,612 | 1/1987 | Forkish . | |
| 4,679,351 | 7/1987 | Zarlengo et al. . | |

*Primary Examiner*—Beth A. Aubrey
*Attorney, Agent, or Firm*—Kenyon & Kenyon

[57] ABSTRACT

An apparatus and method for preventing unauthorized entry into a structure through an opening containing an air conditioner. The present invention relates specifically to an apparatus and method preventing a window-unit air conditioner from being easily pushed into the structure and therefore allowing an intruder to enter through the newly opened window vacated by the window-unit air conditioner. Using clamps and a security bar, the security device of the present invention secures the window-unit air conditioner from being pushed into the building. The device of the present invention is a complete unit, and may be installed without screws.

11 Claims, 2 Drawing Sheets

APPARATUS AND METHOD FOR PREVENTING UNAUTHORIZED ENTRY INTO A STRUCTURE THROUGH AN OPENING CONTAINING AN AIR CONDITIONER

BACKGROUND OF THE INVENTION

1. Field of the Invention

The present invention relates to in-structure security devices. In particular, the present invention is an apparatus and method preventing unauthorized entry into a building through the opening used for an installed air conditioner window unit.

2. Description of the Prior Art

It is known to provide an air conditioner unit which is held in an opening, e.g., a window, of a room to be cooled by the air conditioner. Such window-unit air conditioners generally have a mechanism which prevents the window-unit air conditioner from falling outward from the window of the structure, e.g., building, utilizing a metal lip located on the front part of the air conditioner that sits inside of the window. The bottom part of the window closes onto the top of the air conditioner unit and the window may thereafter be secured in place by a number of different mechanisms. The window thereby supports the air conditioner unit within the window. However, conventional window-unit air conditioners do not provide any features to prevent the air conditioner unit from falling or being pushed inwardly into the structure.

SUMMARY OF THE INVENTION

The object of the apparatus and method of the present invention is to prevent unauthorized entry into structures, e.g., buildings, through an opening, such as a window, containing an air conditioner or similar device. In most residential or commercial structures where the internal environment is controlled by a window-unit air conditioner, there is a high risk of unauthorized break-ins via the opening in which the air conditioner is placed. Frequent break-ins to various structures, residential and commercial, occur because the window-unit air conditioner can be easily pushed into the structure, thereby creating an opening for access to the interior of the structure.

Home-made bars and cage-like closures, which are installed by screws drilled into the window sill or wall, have been constructed and installed in order to prevent occurrences of unauthorized entry via the window. Although such closures prevent unauthorized entry, they can create other problems. First, such closures require that the bars or cages be screwed to the wall or window, and are therefore prone to failure and can cause damage to the wall or window. In addition, such structures can prevent the persons within the structure from leaving through the window in an emergency, such as a fire.

The present invention is an apparatus and method which prevents a window-unit air conditioner from being pushed into a structure—thereby preventing creation of an unauthorized entry point—and can include a clamp-like device that secures to the outside of the window, which wraps around the portion of the air conditioner unit projecting into the structure, and which secures to the base of the window sill. The present invention may be adjustable to accommodate air conditioners of different depths, heights and widths. The present invention is clamped on one side by a C-clamp-like device that secures that side to the window sill, and which may be adjusted on the inside of the structure to accommodate different size window sills.

The device of the present invention does not require any drill-in points or screws and can be secured only via clamps, and therefore does not cause damage to the structure to which it is installed. The device of the present invention uses the directional pressure that would be applied to push the window-unit air conditioner into a structure as a method to prevent entry and to securely hold the window-unit air conditioner in place.

DETAILED DESCRIPTION OF THE INVENTION

Figure 1:
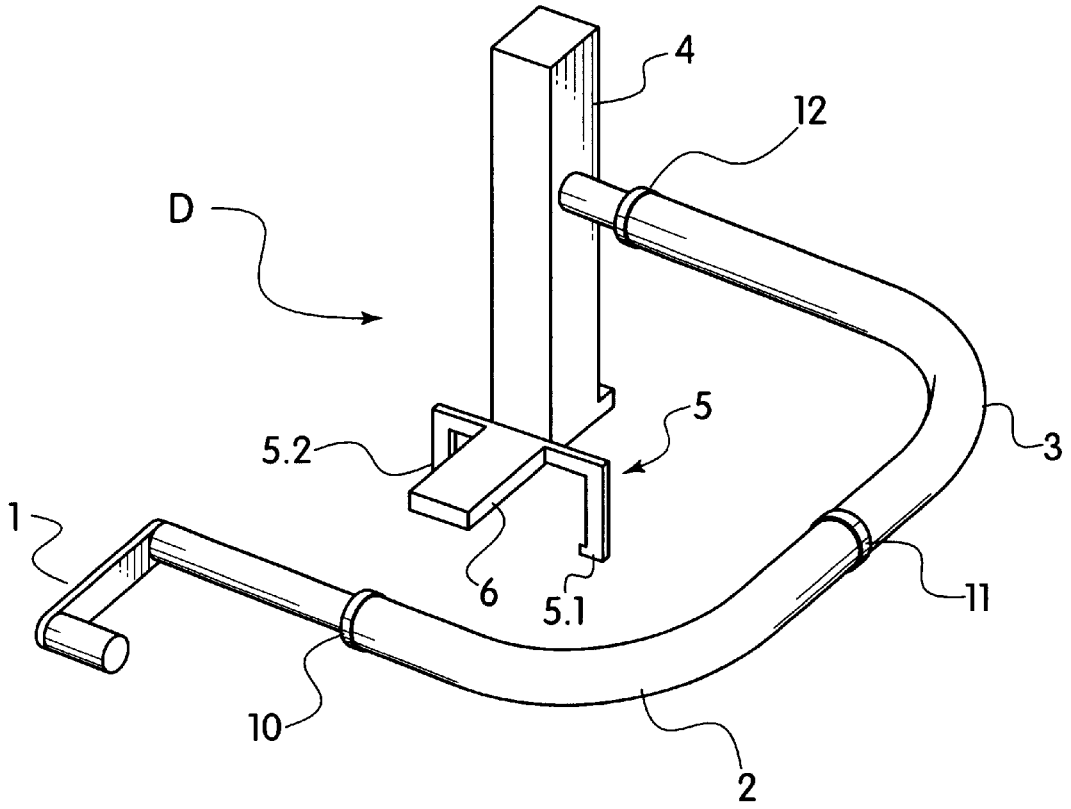
FIG. 1 shows the apparatus of the present invention, in a perspective view.

FIG. 1 is a perspective view of one embodiment of the present invention. The device D includes a first window clamping section 1, which is structured to fit around frame F of the exterior of an opening such as a window W to thereby clamp against the structure, e.g., building, containing the window W. A first window clamping section 1 is connected, by an adjustable connection 10, to a first elbow 2, which wraps around the interior portion of the air conditioning unit A. First window clamping section 1 is preferably J-shaped, and may include a widened section with padding at the end on the outside of the window W, to thereby prevent damage to the window frame F or associated structure. First window clamping section could alternatively include a clamp for clamping to window frame F, either on the inside or the outside, or any other securing portion screwed or otherwise secured to the window W or structure on the inside or the outside. Adjustable connection 10 is preferably in the form used in, e.g., vacuum cleaner hoses, with a first tube of a first diameter sliding into a second tube of a larger diameter, which tubes are secured to one another by a spring-biased ball detent which snaps into one of a series of holes along the length of the larger diameter tube. Adjustable connection 10 allows the device D to be adapted for use with window-unit air conditioners A of varying depths.

A second elbow 3 is connected to the first elbow 2 using an adjustable connection 11 similar to adjustable connection 10, thereby allowing adjustment of the width of the bar formed by the elbows 2, 3 to fit various width window-unit air conditioners A. Second elbow 3 is connected, by an adjustable connection 12 similar to adjustable connection 10, to a tower 4. Tower 4 may be constructed such that adjustable connection 12 slides up and down the length of tower 4 and thereafter locked in position, such that the position of the elbows 2, 3 relative to the air conditioner A may be adjusted. Tower 4 may be welded, or otherwise affixed, to a plate 6. A second window clamping section 5 is welded or otherwise affixed to the plate 6, and clamps to the bottom window sill WS both on the inside and the outside. The inside portion 5.1 of the second window clamping section 5 may telescope relative to the outside portion 5.2, thereby allowing clamping section 5 to adjust to different depths of window sill WS, and portions 5.1, 5.2 may thereafter be rigidly secured to one another, or alternatively rigidly secured to the plate 6, by any known mechanism. The plate 6 may sit under and support the window-unit air conditioner A. Alternatively, window clamping section 5 may be directly connected to elbow 3 via adjustable connection 12, thereby eliminating the need for tower 4 and plate 6. Window clamping section 5 can alternatively be either on the inside or the outside of the structure, or could alternatively could be replaced by any other securing portion screwed or otherwise secured to the window W or structure on the inside or the outside.

Figure 2:
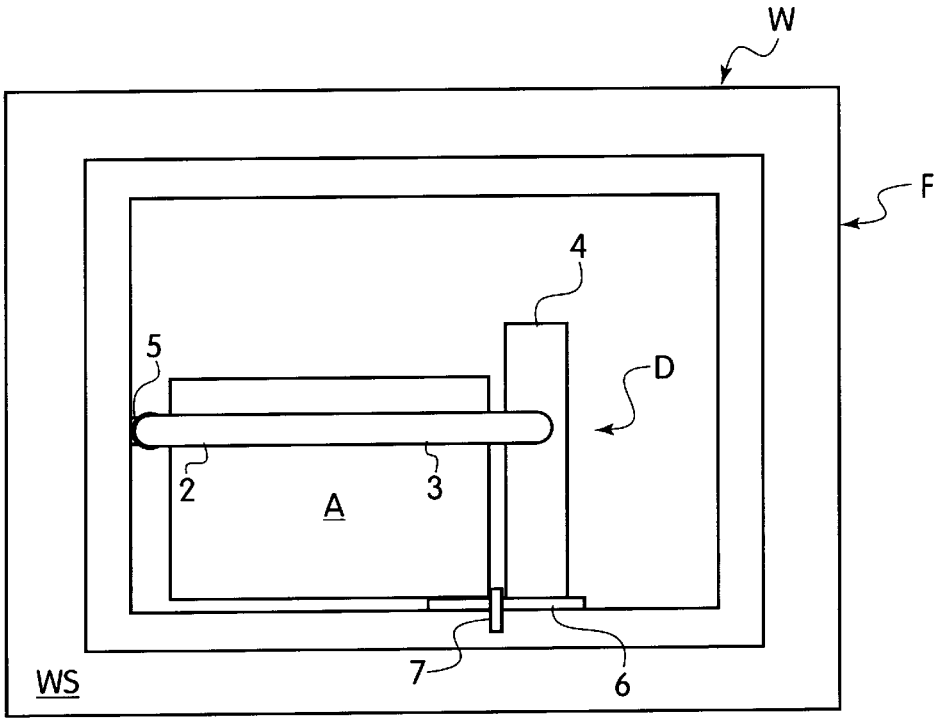
FIG. 2 shows the present invention as applied to a window or enclosure containing a window-unit air conditioner, looking out of the building.
Figure 3:
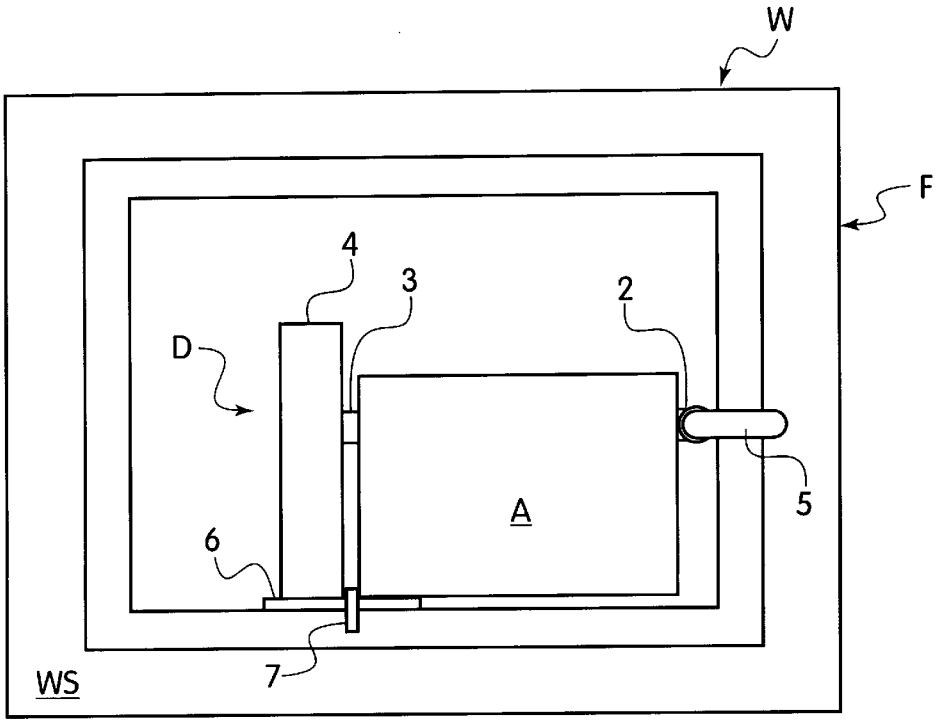
FIG. 3 shows the present invention as applied to a window or enclosure containing a window-unit air conditioner, looking into the building.

FIGS. 2 and 3 show the window-unit air conditioner A in place in a window W with the device D of the present invention attached. The embodiment of FIG. 2 is designed to attach to the frame F on the outside of the window W around the left side (looking out) of the window-unit air conditioner A. It is to be understood that the device D of the present invention could also be configured to attach around the right side of the window-unit air conditioner A.

Attachment and operation of the device D of the present invention is as follows. Tower 4 and plate 6—which are initially unconnected to first window clamping section 1, first elbow 2 and second elbow 3 by disengagement of adjustable connection 12—are placed on window sill WS, and thereafter window-unit air conditioner A is placed on top of plate 6. Tower 4 is clamped to window sill WS by adjusting portions 5.1, 5.2 relative to one another and then securing adjusting portions 5.1, 5.2 to one another to thereby clamp window sill WS. First window clamping section 1, first elbow 2 and second elbow 3 are all connected together, and then first window clamping section 1 is passed through the space between the side of window-unit air conditioner A opposite tower 4, and window frame F. The end of first window clamping section 1 is engaged with the outside of the structure or frame W. Next, adjustable connection 10 is adjusted so that first elbow 2 fits around the interior portion of window-unit air conditioner A. The adjustable connection 11 is then adjusted so that first elbow 2 and second elbow 3 fit across the width of the interior portion of window-unit air conditioner A. Finally, adjustable connection 12 is engaged to secure second elbow 3 to tower 4.

Thereafter, if a person on the outside of the structure attempts to push in window-unit air conditioner A, the interior portion of window-unit air conditioner A will abut against first and second elbows 2, 3. Further pushing force against window-unit air conditioner A will force first window clamping section 1 and second window clamping section 5 against the outside of the frame F, thereby preventing window-unit air conditioner A from inward movement into the structure. Unauthorized entry through the window W is thereby prevented. In the case of an emergency, such as a fire, persons inside the structure may easily remove the device D by uncoupling adjustable connections 10, 12 and pulling in window-unit air conditioner A to thereby create an exit through window W.

Of course, it will be recognized by those skilled in the art that a variety of variations may be made in the construction of the above invention without departing from the claims. As such, the scope of the above invention is limited only by the claims appended hereto.

What is claimed is:

1. An apparatus for preventing unauthorized entry into a structure through an opening containing an air conditioner, the apparatus comprising:

at least one clamp, the at least one clamp comprising two sections movable relative to one another and securable relative to one another to thereby clamp to the structure;

at least one bar, the at least one bar being connected to the at least one clamp, the at least one bar for passing around an interior portion of the air conditioner when the clamp is clamped to the structure, the at least one bar comprising two elbows, the two elbows being connected by an adjustable connection; and at least one clamping section, the at least one clamping section being connected to the at least one bar, the at least one clamping section securing to the structure, to thereby secure the air conditioner against movement into the structure caused by pushing movement from an outside of the structure.

2. An apparatus for preventing unauthorized entry into a structure through an opening containing an air conditioner, the apparatus comprising:

at least one clamp, the at least one clamp comprising two sections movable relative to one another and securable relative to one another to thereby clamp to the structure;

at least one bar, the at least one bar being connected to the at least one clamp, the at least one bar for passing around an interior portion of the air conditioner when the clamp is clamped to the structure; and at least one clamping section, the at least one clamping section being J-shaped and connected to the at least one bar, the at least one clamping section securing to the structure, to thereby secure the air conditioner against movement into the structure caused by pushing movement from an outside of the structure.

3. An apparatus for preventing unauthorized entry into a structure through an opening containing an air conditioner, the apparatus comprising:

at least one clamp, the at least one clamp comprising two sections movable relative to one another and securable relative to one another to thereby clamp to the structure;

at least one bar, the at least one bar being connected to the at least one clamp, the at least one bar for passing around an interior portion of the air conditioner when the clamp is clamped to the structure;

at least one clamping section, the at least one clamping section being connected to the at least one bar, the at least one clamping section securing to the structure, to thereby secure the air conditioner against movement into the structure caused by pushing movement from an outside of the structure;

a tower; and a plate, the plate connecting the tower to the at least one clamp and the at least one bar.

4. An apparatus for preventing unauthorized entry into a structure through an opening containing an air conditioner, the apparatus comprising;

at least one clamp, the at least one clamp comprising two sections movable relative to one another and securable to one another to thereby clamp to the structure;

at least one bar, the at least one bar being connected to the at least one clamp, the at least one bar for passing around an interior portion of the air conditioner when the clamp is clamped to the structure;

at least one clamping section, the at least one clamping section being connected to the at least one bar, the at least one clamping section securing to the structure, to thereby secure the air conditioner against movement into the structure caused by pushing movement from an outside of the structure;

a plate, the at least one clamp being connected to the plate, the plate for underlying the air conditioner when the apparatus is installed in the window; and a tower, the tower being affixed to the plate, the tower connecting the at least one clamp and the at least one bar.

5. A method of preventing unauthorized entry into a structure through an opening containing an air conditioner, the method comprising the steps of:

providing a first securing portion;

securing the first securing portion to the structure;

providing at least one bar;

passing the at least one bar around an interior portion of the air conditioner;

providing a second securing portion;

connecting the second securing portion to the at least one bar;

securing the second securing portion to the structure, to thereby secure the air conditioner against movement into the structure caused by pushing movement from an outside of the structure.

6. The method of claim 5, further comprising the step of:

adjusting the length of the bar to accommodate a width of the air conditioner.

7. The method of claim 5, further comprising:

adjusting the connection between the at least one bar and the second securing portion to thereby accommodate a depth of the air conditioner.

8. The method of claim 5, further comprising the step of:

providing a tower connecting the first securing portion and the at least one bar.

9. The method of claim 5, further comprising the step of:

providing a plate;

installing the air conditioner in the window; and placing the plate under the air conditioner prior to the step of installing the air conditioner in the window.

10. The method of claim 5, wherein:

the step of providing a first securing portion comprises providing at least one clamp; and wherein:

the step of securing the first securing portion comprises clamping the at least one clamp to the structure.

11. The method of claim 5, wherein:

the step of providing a second securing portion comprises providing at least one clamping section.

* * * * *